US005934131A

United States Patent [19]

Shen

[11] Patent Number: 5,934,131

[45] Date of Patent: Aug. 10, 1999

[54] OVERHUNG ROLL ASSEMBLY

[75] Inventor: Xiaolan Shen, Boylston, Mass.

[73] Assignee: Morgan Construction Company, Worcester, Mass.

[21] Appl. No.: 09/131,620

[22] Filed: Aug. 10, 1998

[51] Int. Cl.[6] ..... B21B 39/20

[52] U.S. Cl. ..... 72/252.5

[58] Field of Search ..... 72/237, 238, 239, 72/252.5; 384/538; 464/30, 45, 46; 403/11, 13, 14, 15; 492/1, 21, 27, 47

[56] References Cited

U.S. PATENT DOCUMENTS

| | | | |
|---|---|---|---|
| 3,803,691 | 4/1974 | Geese et al. | 492/27 |
| 3,866,283 | 2/1975 | Gould | 72/238 |
| 4,881,310 | 11/1989 | Wykes et al. | 492/27 |
| 5,665,044 | 9/1997 | Tomat et al. | 492/47 |

FOREIGN PATENT DOCUMENTS

| | | | |
|---|---|---|---|
| 454067-A | 12/1974 | U.S.S.R. | 492/27 |

*Primary Examiner*—Rodney Butler
*Attorney, Agent, or Firm*—Samuels, Gauthier & Stevens

[57] ABSTRACT

A rolling mill assembly includes a support shaft having a tapered section leading from an abutment to an end section. A ring-shaped roll having inboard and outboard flanks and a cylindrical bore is axially mounted on the shaft with its inboard flank seated against the abutment and with its cylindrical bore surrounding the tapered shaft section. A tapered sleeve is interposed between the tapered shaft section of and the cylindrical roll bore. A circular retainer is axially received on and rotatably fixed with respect to the end section of the shaft. A nut is threaded onto the end section of the shaft to operate via the retainer to center the roll on the shaft by tightly inserting the sleeve between the tapered shaft section and the cylindrical roll bore. Screw members are threaded though the retainer into axial engagement with the outboard flank of the roll to urge the inboard flank of the roll against the abutment.

9 Claims, 3 Drawing Sheets

OVERHUNG ROLL ASSEMBLY

BACKGROUND OF THE INVENTION

1. Field of the Invention

This invention relates generally to rolling mills, and is concerned in particular with an improved roll assembly of the "overhung" type, where ring shaped work rolls are mounted on the ends of driven roll shafts.

2. Description of the Prior Art

In the typical overhung roll assembly, a ring shaped roll has a cylindrical bore received on a tapered section of a driven roll supporting shaft. A tapered sleeve is inserted in wedged engagement between the tapered roll shaft section and the cylindrical roll bore. In some cases, the wedged engagement of the sleeve serves as the primary means of transmitting torque from the roll shaft to the roll. In other cases, the tapered sleeve mainly serves as a centering device, with torque being transmitted from the roll shaft to the roll by other means, e.g., through keys or other like mechanical interengagements, or by hydraulically loading adjacent components of the roll assembly against the roll flanks to transmit torque by frictional contact.

When the tapered sleeve serves as the primary torque transmitting component, it exerts substantial radial force on the roll. The roll must therefore be radially thickened in order to provide the strength required to withstand the resulting increased hoop stress. The increased thickness of the roll is accommodated by a reduction in the shaft diameter, which disadvantageously reduces shaft rigidity.

Axial loading of the tapered sleeves or other torque transmitting components of conventional roll assemblies is typically achieved by specially designed hydraulically actuated tools. Such tools are expensive and extremely heavy, usually requiring maintenance personnel to employ lift cranes when engaging and disengaging the tools from the roll assemblies. Non-productive mill downtime is thus prolonged because most mill installations only have a limited number of lift cranes available for use by maintenance personnel.

An objective of the present invention is to provide an overhung roll assembly in which the tapered sleeve serves primarily as a centering device, with torque being transmitted from the roll shaft to the roll by other components of the roll assembly in frictional contact with the roll flanks. Roll hoop stresses are thus advantageously reduced, making it possible to achieve a corresponding reduction in roll thickness and a beneficial increase in shaft diameter.

A companion objective of the present invention is the provision of a simple mechanically actuated arrangement for axially loading the torque transmitting roll assembly components acting in frictional contact with the roll flanks. This is accomplished through the use of low cost light weight tools which can be employed by maintenance personnel without resort to auxiliary equipment such as overhead lift cranes.

SUMMARY OF THE INVENTION

In a preferred embodiment of the invention to be described hereinafter in greater detail, the foregoing objectives and advantages are achieved by rotatably fixing an axially shiftable circular retainer adjacent to both the outboard flank of the ring shaped roll and the outboard end of the tapered sleeve, the latter having been loosely inserted between the tapered section of the roll shaft and the cylindrical bore of the work roll. A nut is then threaded onto the end of the shaft. The nut acts against the circular retainer, which is in turn abuts and urges the tapered sleeve into a tightly inserted centering position between the tapered shaft section and the cylindrical roll bore. Jackscrews threaded through the retainer are then tightened against the outboard roll flank to clamp the inboard roll flank against an adjacent abutment, which typically will comprise an enlarged diameter circular shoulder on the roll shaft. The resulting frictional contact of the jackscrews and shaft abutment with the opposed roll flanks serves as the primary torque transmitting means.

Preferably, the circular retainer is axially coupled to the tapered sleeve by means of a bayonet connection or the like. Thus, removal of the nut followed by continued tightening of the jackscrews will result in the tapered sleeve being extracted from its tightly inserted centering position, thereby freeing the roll for removal from the roll shaft.

These and other objectives, features and advantages of the present invention will now be described in greater detail with reference to the accompanying drawings, wherein:

DETAILED DESCRIPTION OF PREFERRED EMBODIMENTS

Figure 2:
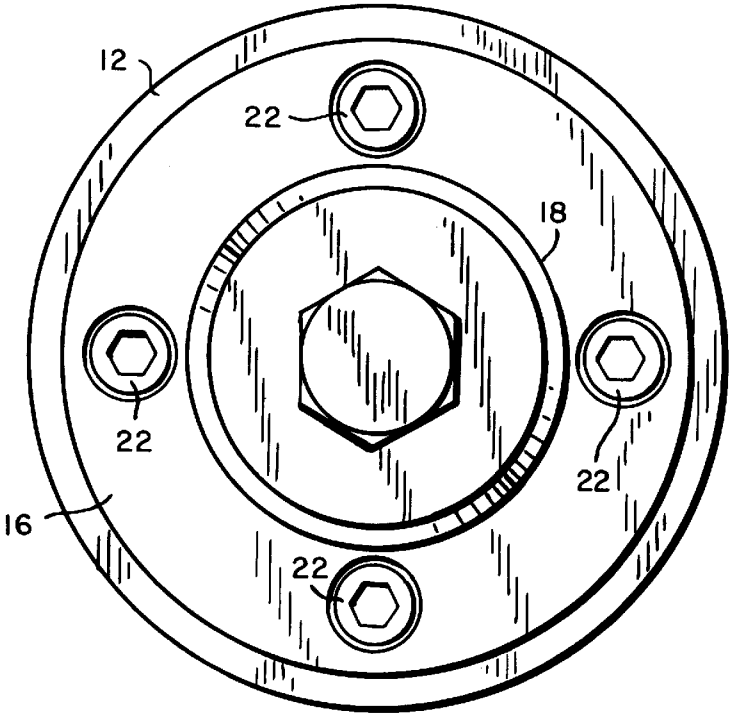
FIG. 2 is an end view of the roll assembly looking from right to left in FIG. 1.

Referring now to the drawings, a roll shaft 10 has a tapered section 10*a* leading from an abutment in the form of a circular shoulder 10*b* to reduced diameter end section 10*c* having a threaded end 10*d*. A ring shaped roll 12 has inboard and outboard flanks, 12*a*, 12*b* and a cylindrical bore 12*c*. The roll 12 is axially mounted on the shaft 10, with its inboard flank 12*a* seated against the abutment shoulder 10*b* and with its cylindrical bore 12*c* surrounding the tapered shaft section 10*a*.

The shaft 10 is journalled for rotation in a housing 11 by bearings, one of which is depicted at 13. A seal assembly "S" serves to retain lubricant in the housing while excluding externally applied cooling water.

A tapered sleeve 14 is interposed between the tapered shaft section 10*a* and the cylindrical bore 12*c* of the roll 12. The outboard end of the sleeve includes a collar with a circular groove 14*a* located inwardly of circumferentially spaced radially outwardly protruding lugs 14*b*.

Figure 3:
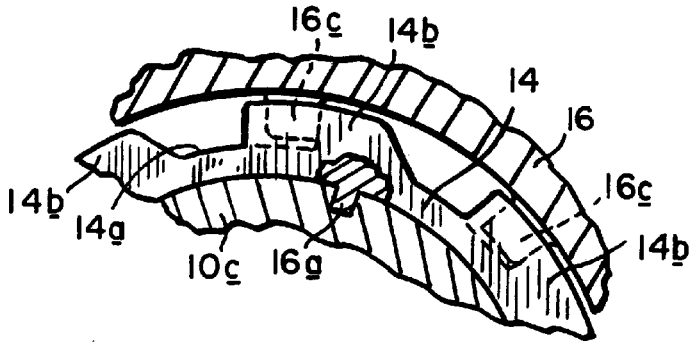
FIG. 3 is a partial cross sectional view taken along line 3—3 of FIG. 1.

A circular roll retainer 16 is axially received on the shaft end section 10*c*. The retainer is axially shiftable, but is rotatably fixed with respect to the shaft 10 by any convenient means, for example by inwardly protruding keys 16*a* received in keyways 10*e* in the shaft section 10*c*. The retainer 16 is internally grooved as at 16*b* adjacent to circumferentially spaced inwardly protruding lugs 16*c*. As can best be seen in FIG. 3, the lugs 16*c* are configured and arranged to coact in a bayonet type mechanical interengagement with the lugs 14*b* of the sleeve 14 to axially couple the retainer to the sleeve.

Figure 1:
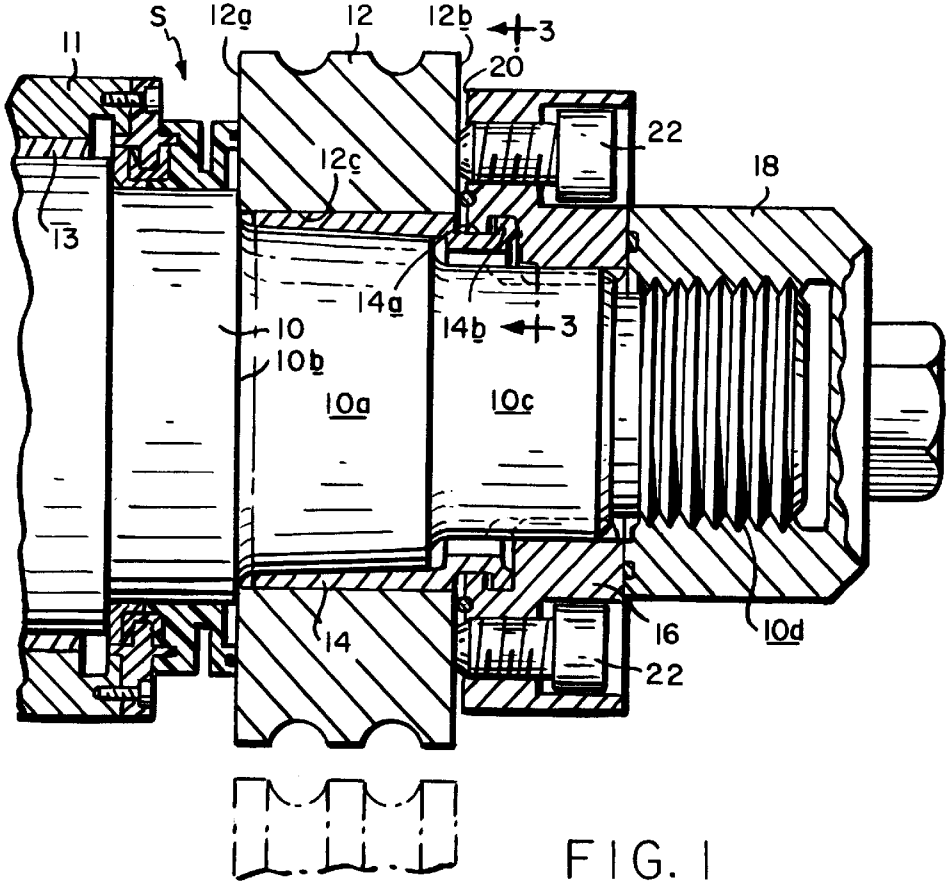
FIG. 1 is a longitudinal sectional view taken through a roll assembly in accordance with the present invention.

A nut 18 is threaded onto the threaded end section 10*d* of the shaft. The nut is operative via the retainer 16 to tightly insert the sleeve 14 between the tapered shaft section 10*a* and the cylindrical roll bore 12*c*, thereby centering the roll 12 on the shaft 10. With the nut thus tightened, the outboard roll flank 12*b* and the adjacent inboard face of the retainer 16 will either be in face-to-face contact, or there may be a slight clearance therebetween as indicated at 20 in FIG. 1.

Jackscrews 22 are threaded through the retainer 16 into axial engagement with the outboard flank 12*b* of the roll 12. As the jackscrews are tightened, the inboard flank 12*a* of the roll is urged against the shaft abutment shoulder 10*b*, and the retainer 16 is confmed against movement in the opposite direction by the nut 18.

The opposed axial forces exerted on the roll flanks 12*a*, 12*b* by the abutment shoulder 10*b* and the jack screws 22 generate the frictional forces required to transmit torque from the roll shaft 10 via the retainer 16 to the roll 12.

Figure 5:
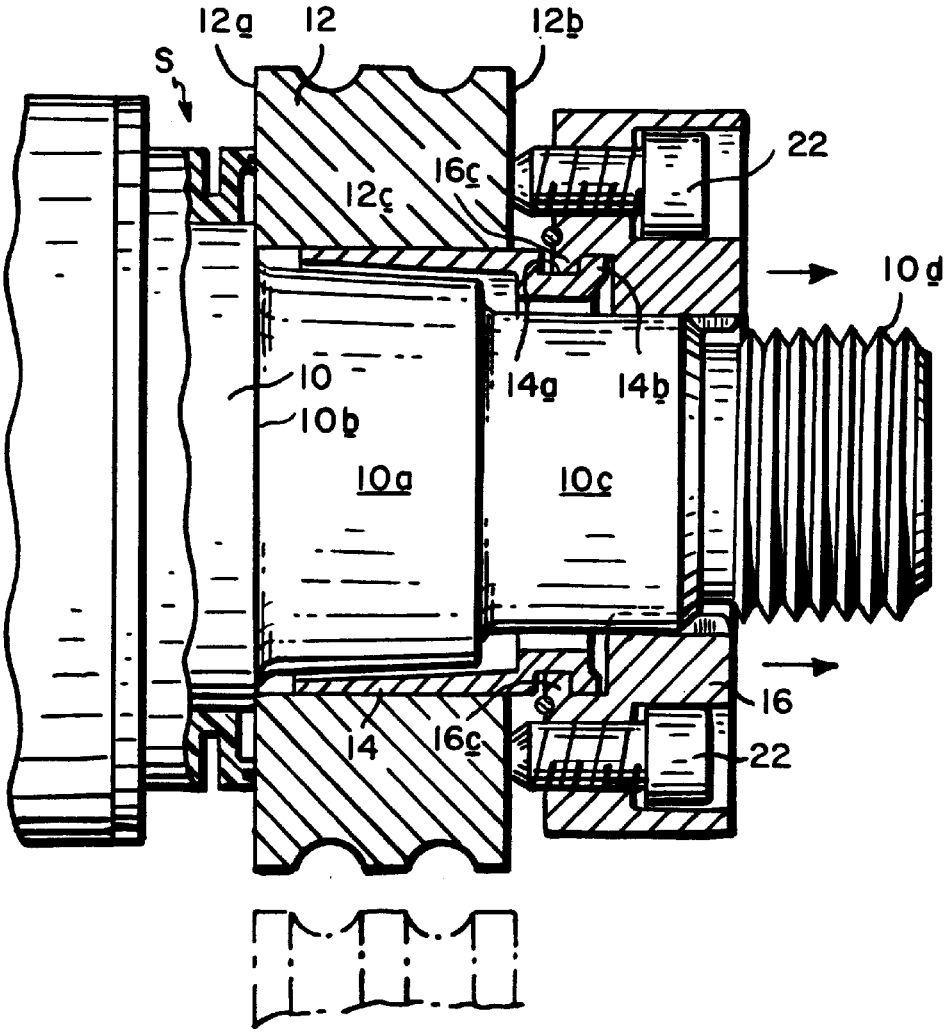
FIG. 5 is a view similar to FIG. 1 showing the components of the roll assembly in a sleeve extraction mode.
Figure 4:
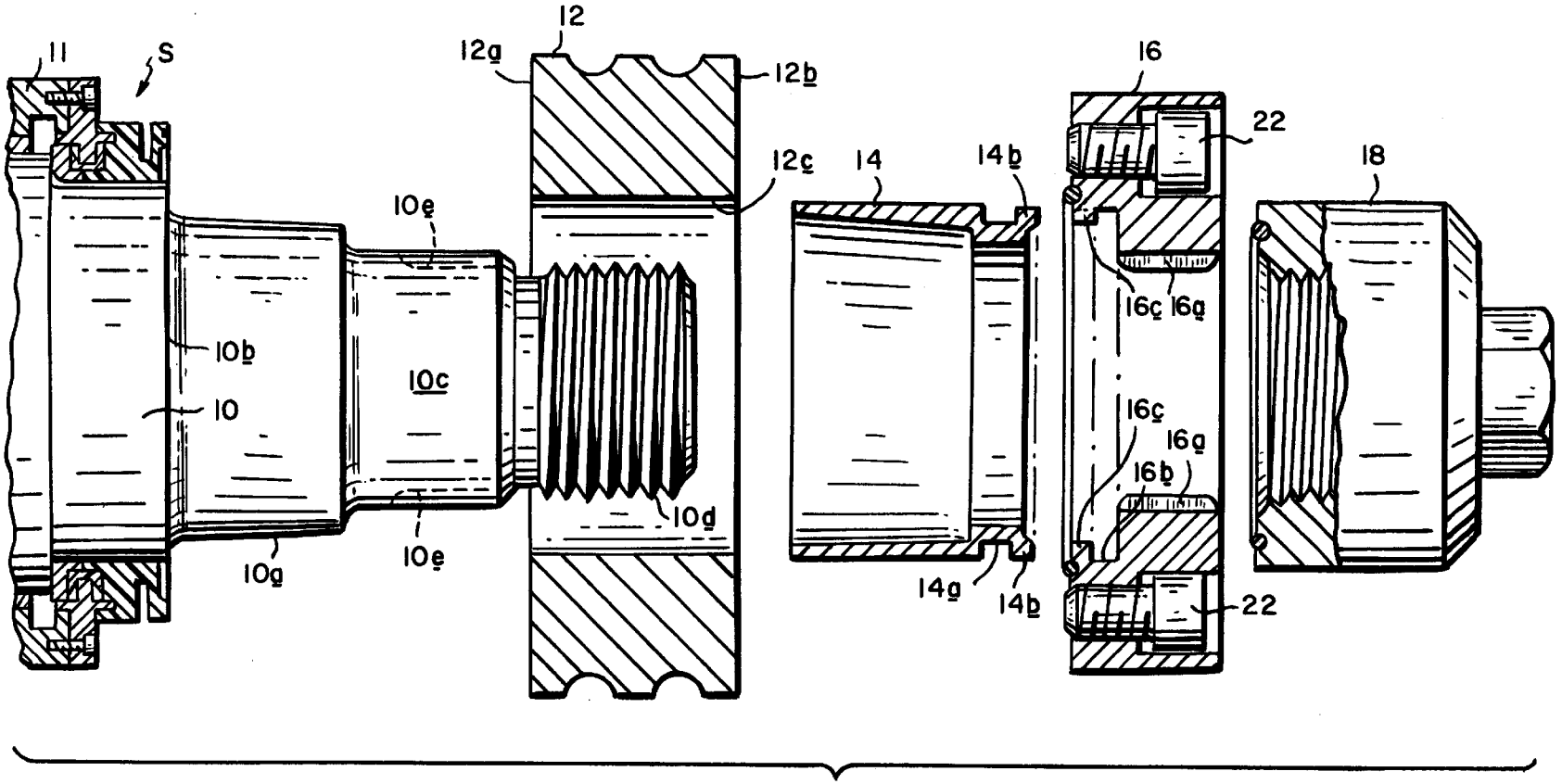
FIG. 4 is an exploded view of the roll assembly.

As can best be seen by reference to FIG. 5, roll removal is easily accomplished by first removing the nut 18 and then continuing to tighten the jackscrews 22. This will force the retainer 16 away from the outboard roll flank 12*b*, with an accompanying extraction of the tapered sleeve 14 as a result of the mechanical interengagement of the retainer lugs 16*c* with the sleeve lugs 14*b*.

In light of the foregoing, it will now be appreciated by those skilled in the art that the present invention offers a number of significant advantages over conventional roll mounting assemblies. For example, the role of the tapered sleeve 14 is restricted primarily to centering the roll 12 on the tapered shaft section 10*a*. As a result, the roll is subjected to only moderate hoop stresses. The designer can thus reduce roll thickness, with a corresponding beneficial increase in shaft diameter. The lower hoop stresses also result in the rolls 12 and the sleeves 14 having longer useful lives.

The sleeve 14 is seated in its operative position simply by tightening nut 18. This can be accomplished by mill personnel using standard light weight relatively inexpensive air wrenches.

Torque is transmitted primarily by the exertion of opposed axially generated frictional forces on the roll flanks. These forces are developed simply by tightening the jackscrews 22, which again can be accomplished with standard air wrenches. The same tools can be employed to extract the tapered sleeve 14 during roll removal.

Various changes and modifications may be made to the embodiment herein chosen for purposes of disclosure. By way of example only and without limitation, the retainer 16 may be rotatably fixed to the shaft 10 by other known and functionally equivalent arrangements, such as machining coacting flat surfaces on the shaft section 10*c* and the interior bore of the retainer. Spacer rings or the like may be interposed between any of the axially arranged components, e.g., between the shoulder 10*b* and inboard roll flank 12*a*, between the outboard roll flank 12*b* and the retainer 16, etc.

It is my intention to cover these and any other mechanically and functionally equivalent changes and modifications which do not depart from the overall concept of the present invention as defined by the claims appended hereto.

I claim:

1. A rolling mill roll assembly comprising:

a support shaft having a tapered section leading from an abutment to an end section;

a ring-shaped roll having inboard and outboard flanks and a cylindrical bore, said roll being axially mounted on said shaft with its inboard flank seated against said abutment and with its cylindrical bore surrounding the tapered shaft section;

a tapered sleeve interposed between the tapered shaft section of and the cylindrical bore of said roll;

a circular retainer axially received on and rotatably fixed with respect to the end section of said shaft;

coupling means for axially coupling said retainer to said sleeve;

a nut threaded onto the end section of said shaft, said nut being operative via said retainer to center said roll on said shaft by tightly inserting said sleeve between said tapered shaft section and the cylindrical roll bore; and screw members threaded through said retainer into axial engagement with the outboard flank of said roll to urge the inboard flank of said roll against said abutment, wherein a loosening of said nut followed by tightening of said screw members will act via said retainer to axially extract said sleeve from between said shaft and said roll.

2. A rolling mill roll assembly comprising:

a support shaft having a tapered section leading from an abutment to an end section;

a ring-shaped roll having inboard and outboard flanks and a cylindrical bore, said roll being axially mounted on said shaft with its inboard flank seated against said abutment and with its cylindrical bore surrounding the tapered shaft section;

a tapered sleeve interposed between the tapered shaft section and the cylindrical bore of said roll;

a circular retainer axially received on and rotatably fixed with respect to the end section of said shaft;

a nut threaded onto the end section of said shaft, said nut being operative via said retainer to center said roll on said shaft by tightly inserting said sleeve between said tapered shaft section and the cylindrical roll bore; and screw members threaded through said retainer into axial engagement with the outboard flank of said roll to urge the inboard flank of said roll against said abutment.

3. The roll assembly of claim 2 further comprising coupling means for axially coupling said retainer to said sleeve.

4. The roll assembly of claim 2 wherein said circular retainer is interposed axially between and abutted by both said sleeve and said nut.

5. The roll assembly of claim 2 wherein said screw members are engageable with the outboard flank of said roll at circumferentially spaced locations.

6. The roll assembly of claim 2 wherein said abutment comprises an enlarged diameter circular shoulder on said shaft.

7. The roll assembly of claim 3 wherein said coupling means comprises circumferentially spaced lugs on said sleeve coacting in mechanical interengagement with circumferentially spaced lugs on said retainer.

8. The roll assembly of claim 3 wherein a loosening of said nut followed by tightening of said screw members will act via said retainer to axially extract said sleeve from between said shaft and said roll.

9. A rolling mill assembly comprising:

a support shaft having a tapered section located between an abutment and a reduced diameter end section;

a ring shaped roll having inboard and outboard flanks and a cylindrical bore, said roll being axially received on the tapered section of said shaft;

a tapered sleeve interposed between the tapered section of said shaft and said roll, said sleeve having an outboard end projecting axially from the outboard flank of said roll;

a circular retainer axially received on the end section of said shaft at a location adjacent to the outboard end of said sleeve and spaced axially from the outboard flank of said roll;

first means threaded onto the end section of said shaft for axially urging said retainer towards the outboard flank of said roll and for urging said sleeve into tight inser tion between the tapered section of said shaft and the cylindrical bore of said roll; and second means threaded through said retainer into axial engagement with the outboard flank of said roll for axially urging the inboard flank of said roll against said abutment.

* * * * *